United States Patent [19]

Jordan et al.

[11] Patent Number: 4,997,042

[45] Date of Patent: Mar. 5, 1991

[54] CASING CIRCULATOR AND METHOD

[76] Inventors: Ronald A. Jordan, Lange Houstraat 31, Den Haag, 2511 CV, Netherlands; Charles O. Stokely, 4535 Oakshire Dr.; Lawrence Sanford, 4619 Shetland, both of Houston, Tex. 77027; James M. Mounteer, c/o Mobil Oil, 1250 Poydras Plaza, New Orleans, La. 70113-1892

[21] Appl. No.: 460,566

[22] Filed: Jan. 3, 1990

[51] Int. Cl.[5] ..... E21B 33/04

[52] U.S. Cl. ..... 166/379; 166/387; 166/85; 166/187

[58] Field of Search ..... 166/379, 387, 77, 77.5, 166/85, 187, 380, 381, 90

[56] References Cited

U.S. PATENT DOCUMENTS

| | | | |
|---|---|---|---|
| 4,076,083 | 2/1978 | Sizei | 175/65 |
| 4,817,724 | 4/1989 | Funderberg, Jr. et al. | 166/337 |
| 4,913,231 | 4/1990 | Muller et al. | 166/187 X |

OTHER PUBLICATIONS

Halliburton Advertisement, Oil & Gas Journal, Apr. 17, 1989, "Halliburton can be on the Casing and Ready to Cement this Fast with its new Quick-Latch Coupler Head".

*Primary Examiner*—William P. Neuder

*Attorney, Agent, or Firm*—Browning, Bushman, Anderson & Brookhart

[57] ABSTRACT

Improved methods and apparatus are provided for sealing at the uppermost end of a casing string to provide circulation from adjacent the lower end of the casing string and into a well bore to enable the casing string to be more easily lowered into the well bore. A casing circulator is provided for lowering into the uppermost end of the casing string above the rig floor, and for sealing with an interior surface of the uppermost end of the casing string. An external sealing member of the casing circulator may be moved axially with respect to an inner packer tube, thereby allowing the sealing member to become inflated while also enabling fluid to pass through the casing circulator and into the casing string. The techniques of the present invention may also be used to fill the casing string as it is lowered into the well bore.

20 Claims, 3 Drawing Sheets

CASING CIRCULATOR AND METHOD

BACKGROUND OF THE INVENTION

1. Field of the Invention

The present invention relates to methods and apparatus for sealing the top of oil field casing to circulate fluid through the casing and into the well bore, and more particularly relates to simple and reliable techniques for sealing and circulating fluid through the casing utilizing equipment which may also be employed to fill the casing with fluid as it is being run into the well.

2. Description of the Background

In the oil recovery business, casing is commonly used as the outer conduit in a well bore, while tubing and drill pipe are generally positioned within the casing. When lowering casing into a well bore (also called running casing into a hole), it is not unusual to encounter difficulty in getting the casing to the desired depth in the hole, especially when the bore hole is highly deviated. Typically, casing is "unstuck" in a hole by circulating fluid, such as drilling mud, down the casing to wash sand or other debris away from the vicinity of the lowermost end of the casing.

In most instances, this circulation requires the operator to "rig-up" on top of the uppermost end of the casing string, which typically is from 10' to 40' above the drilling rig floor. Since the position of the upper end of the casing string for this rig-up operation varies with the depth of the stuck casing in the well, the height at which rig-up occurs varies and the uppermost end of the casing string is thus not readily accessible to the operator. Accordingly, an operator is frequently suspended in the air from a safety harness to perform "rig up" on the uppermost threaded end of the casing string. Once rig-up has occurred, drilling fluid is typically circulated into the top of the casing string to achieve the washing operation, at which time the casing can be further lowered simultaneously or subsequently into the well bore.

In a conventional rig up operation, a circulating sub is threaded onto the uppermost threads of the last joint of casing added to the string. Since this procedure commonly takes 30 minutes or more and, once the casing becomes stuck in the well bore, each successive joint of casing is likely to become restuck while the casing is run into the well, hours of valuable rig time and effort are required simply to attach and detach this circulating sub from the top of the casing string so that fluid can be circulated for the washing operation and the casing again lowered into the well.

Another common problem with lowering casing into a well bore is related to getting fluid into the casing as it is lowered into the well bore. While a check valve is typically provided at the lowermost end of the casing string to prevent well fluid from entering the interior of the casing as it is run into the well, fluid must be added to the lowered casing to prevent collapse of the casing during the run in operation. In most instances, a fill line from the existing mud pumps is manually placed into the exposed upper end of the casing string to fill the casing at desired intervals with fluid. This procedure typically takes several minutes per joint of casing, which amounts again to a considerable loss of rig time while running casing into a deep well.

The benefit of more quickly inputting a fluid into casing positioned in a bore hole has long been recognized in the industry, and accordingly others have devised techniques for sealing the top of the casing string without threading a tool to the casing. Various types of quick couplers have been devised for positioning at the upper end of a casing string to circulate cementing fluid through the casing. These devices are not, however, generally suitable for circulating drilling or washing fluid into casing, since it still takes a considerable amount of time to properly install the coupler on the uppermost end of the casing string. Moreover, these devices do not overcome the previously mentioned problems concerned with the safety risks and an expense associated with circulating fluid into a casing by positioning an operator at varying heights far above the rig floor. Finally, these quick couplers do not solve the problems associated with easily filling the casing with drilling mud as a casing is run into the well.

The disadvantages of the prior art are overcome by the present invention, and improved methods and apparatus are hereinafter disclosed for easily and reliably circulating fluid through casing and into a well bore and/or filling casing with fluid as it is lowered into the well bore.

SUMMARY OF THE INVENTION

The techniques for the present invention are applicable to easily and inexpensively inputting drilling mud into a casing positioned within a well bore. The fluid may be used for conventional washing operation to enable the casing to be more easily lowered into the well bore, and may also be used for filling the casing with mud during the casing run in operation to prevent collapse of the casing due to pressure differential across the casing wall.

For purposes of this discussion, it will be presumed that the casing circulator and the techniques for inputting fluids to a casing string as discussed herein are applied to a top drive rig, which is particularly well suited to obtain the advantages of the present invention. The methods and apparatus may, however, also be used with a "side drive" rig or any other type of rig, and those skilled in the art appreciate the general advantages of each of these types of rigs apart from the additional advantages which arise from the teachings of the present invention.

The casing circulator comprises a packer tube having a central flow path for transmitting fluid through the circulator. A top sub is connected to the upper end of the packer tube, and includes internal threads for connecting an upper drill pipe pup joint thereto. A sleeve-shaped inflation element is positioned exterior of the packer tube, is sealed on the packer tube at both ends to form an inflatable chamber between the inflation element and the tube, and is axially moveable with respect to the tube. A lower guide member is secured to the lowermost end of the packer tube to assist in guiding the tool into the interior of the casing string.

The inflation element is selectively actuatable for providing sealing engagement between the interior surface of the casing and the packer tube. Although a fluid-actuatable sealing element is preferred, other types of sealing means can be used in accordance with the present invention. A plurality of slots may be provided in the packer tube to allow fluid to enter and inflate the sealing element, and the sealing element may be axially moved so that pressure is sealed (packer set) while the slots provide communication between the interior of the packer tube and the interior of the casing below the sealing element.

According to the method of the present invention, the casing circulator may be positioned within the upper end of the casing string supported from a pup joint which in turn is suspended from the traveling blocks of the rig. During normal operations, the inflation element is in its unset position, and the slots in the packer tube are positioned below the inflation element so that the interior of the casing is open to the interior of the pup joints. Accordingly, the casing may be easily filled as the casing is run into the bore hole.

In the event the casing becomes stuck in the well bore, the inflation element may be set by actuating the drawworks at the rig floor to lift the traveling blocks upward. The packer tube connected with the traveling blocks thus moves up with respect to the inflation element, causing the slot to rise above the seals in the lower packer sub and fill the inflation element. The subsequent lowering of the packer tube seals the inflation element in its set position, and again opens the slots to the interior of the casing so that mud may be pumped through the casing circulator and into the casing for performing the washing out operation. Once washout is complete, the mud pump may be shut off and the packer tube raised to deflate the inflation element. The process may be easily repeated each time the casing becomes stuck in the bore hole.

It is an object of the present invention that provided improved techniques for easily and quickly performing a washing operation to assist in lowering casing into a well.

It is another object to provide a readily actuatable casing circulator within the upper end of a casing string, so that the casing circulator may be actuated to seal with the casing interior walls while enabling fluid to be pumped through the casing circulator and into the casing.

It is a feature of the present invention that rig operator safety is enhanced since an operator need not be suspended adjacent the upper end of the casing string to rig up the casing for a washing operation.

It is another feature of the invention that the casing circulator be used for performing a casing washing operation, and the same casing circulator may also be used for easily filling the casing as the casing is run into the well.

It is an advantage of the present invention the casing circulator employ an inflatable sealing element for sealing with the interior walls of the casing.

It is still a further advantage of the present invention that the techniques described herein maybe used with a top drive, or side drive rig.

These and further objects, features, and advantages of the present invention will become apparent from the following detailed description, wherein references made to the figures in the accompanying drawings.

DETAILED DESCRIPTION OF PREFERRED EMBODIMENTS

Figure 1:
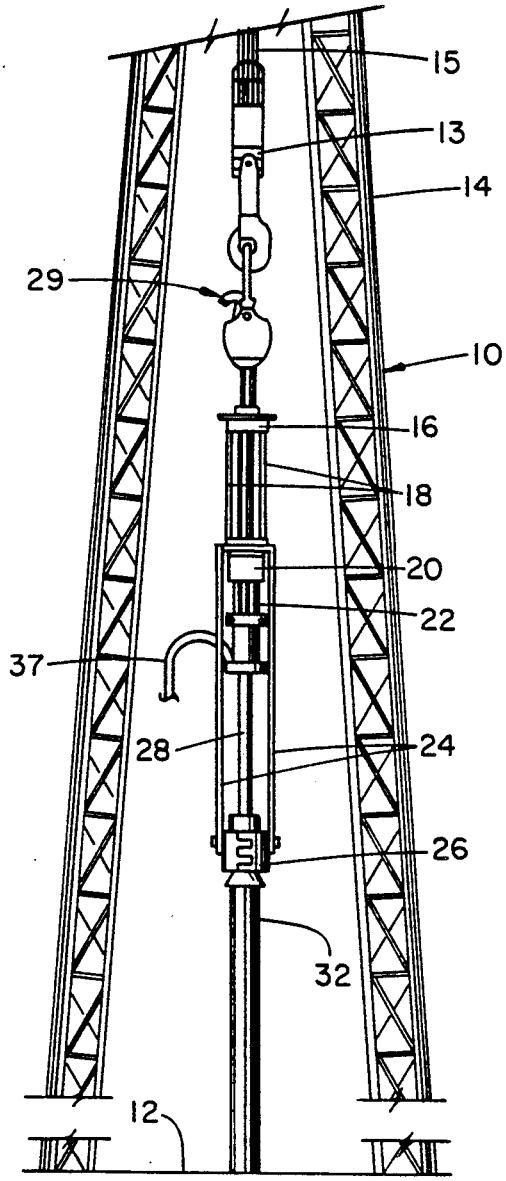
FIG. 1 is a simplified side view of a top drive rig which may be used in accordance with the present invention.

FIG. 1 depicts a portion of the conventional top drive drilling rig 10 which is well suited to achieve the benefits of the present invention. Those skilled in the art will appreciate that the advantages of this invention are also applicable to running casing from a side drive rig. The rig 10 shown in FIG. 1 may thus consist of a conventional rig floor 12 and a suitable structure or masts 14 extending above the rig floor for supporting a stationary crown block (not shown). Wire cables 15 conventionally extend from drawworks adjacent the rig floor to the crown blocks and then to the traveling blocks 13 so that traveling blocks 13 can be easily moved up or down relative to the rig floor by actuation of the drawworks.

The top drive rig 10 shown in FIG. 1 may include a rotational lock mechanism 16, a pair of torque arrestors 18, a link tilt assembly 20, top drive torque wrench 22 including a top drive actuator assembly, a pair of bales or links 24, and a casing elevator 26. This apparatus is conventional and well known to those skilled in the art, and accordingly will not be discussed in detail herein. It should be understood that the uppermost portion of the casing string 32 may be gripped by the elevator 26, so that actuation of the drawworks can be used to lower the casing elevator 26 and thus the casing into the hole. FIG. 1 thus depicts the casing string 32 suspended from the elevator 26, and also depicts a drill pipe pup joint 28 extending downward from the actuator assembly within the top drive torque wrench 22 to the casing circulator (which is not shown in FIG. 1 since it is positioned radially within the uppermost end of the casing string 32). Fluid from pumps adjacent the rig floor may be passed to the top drive equipment via flexible line 29, and then passed through the pup joint 28 to the interior of the packer tube 40 as shown FIG. 2. As explained subsequently, a backup flexible flow line 37 could also be used to pass pressurized fluid to the pup joint 28 and then to the casing circulator 30, which enables the techniques of the present invention to be used if a top drive or side drive rig is not employed.

Figure 2:
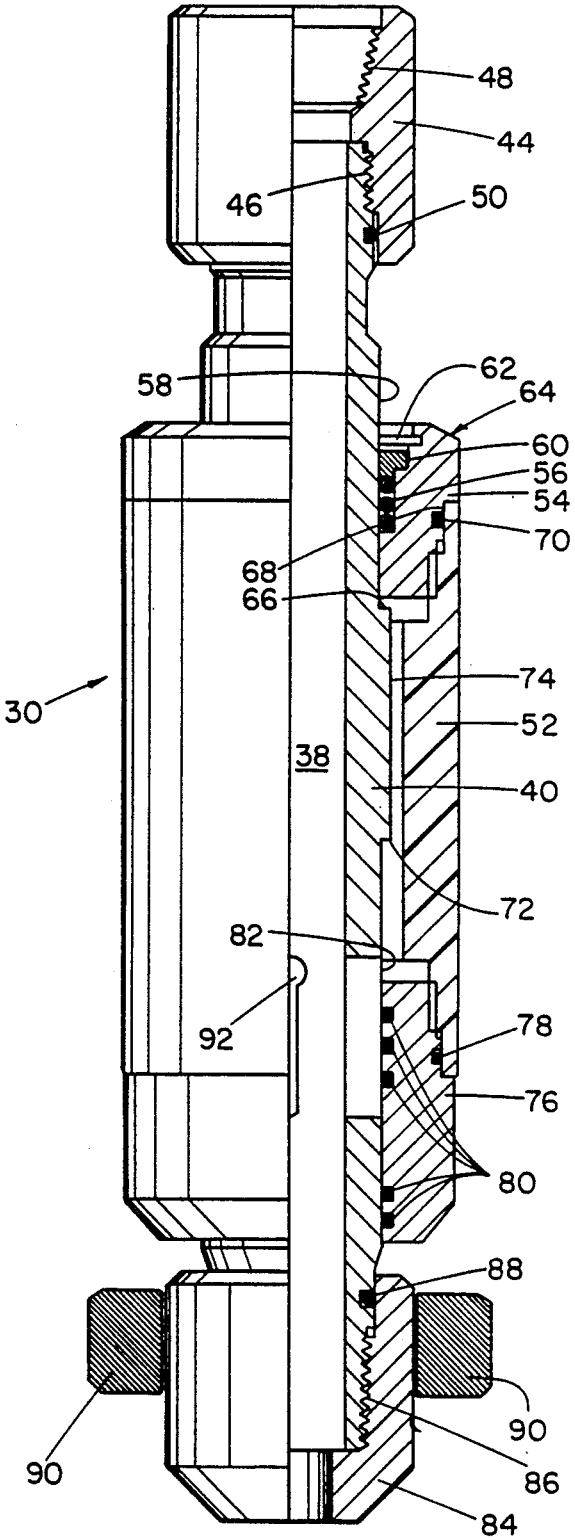
FIG. 2 is a detailed half-sectional view of the casing circulator according to the present invention.

Details with respect to the casing circulator 30 are shown in FIG. 2. The casing circulator consists of a packer tube 40 having a central flow path 38 for passing fluid through the casing circulator, as explained subsequently. A top sub 44 is connected to the upper end of the packer tube 40 by threads 46, and a fluid tight connection between the top sub and the packer tube is achieved by annular seal 50. The top sub 44 includes conventional internal tapered threads 48 for forming a fluid tight connection with the threaded end of the drill pipe pup joint 28 shown in FIG. 1.

An upper external cylindrical-shaped surface 58 of the packer tube 40 forms a seal with the upper packer sub 54 by plurality of annular seals 56. The packer sub 54 includes a spacer ring 60, a snap ring 62, and plug 64, each of which is not discussed in detail herein since these components are commonly used in the design and manufacture of inflatable packers. Accordingly, it should be understood that the upper packer sub 54 may move axially upward toward the top sub 44 along the cylindrical exterior surface 58, as explained subsequently, while maintaining sealed engagement between the upper packer sub 54 and the packer tube 40. Downward movement of the packer sub 54 with respect to the packer tube is limited by stop surface 66 formed on the packer tube.

The inflation element 52 is secured at its upper end to the packer sub 54 in a manner conventional to inflatable packers, and a fluid-tight connection between these components may be provided by annular seal 70. Even when the inflation element was in its deflated condition, as shown in FIG. 2, a thin annular gap 74 may thus exist between the exterior surface of the packer tube and the interior of the inflation element, and this gap 74 may subsequently be filled with pressurized fluid to expand the inflation element 52 outward into sealed engagement with the casing string.

A lower packer sub 76 is secured to the lower end of the inflation element 52, and a plurality of seals 80 carried by the lower sub provides sealing engagement between the exterior cylindrical-shaped surface 82 of the packer tube 40 and the lower sub 76. Accordingly, those skilled in the art appreciate that as the packer is inflated, the lower sub 76 moves axially closer to the upper packer sub 54 to accommodate radialy outward expansion of the inflation element 52. Upward movement of the lower sub 76 with respect to the packer tube 40 is limited by stop surface 72. Again, a fluid tight connection between the inflation element and the lower sub may be provided by seal 78.

Guide member 84 is connected to the lower end of packer tube 40 by threads 86. A variety of different types of guide projections 90 may extend outwardly from 84, and assist in guiding the assembly 30 into the upper end of the casing string, as explained subsequently. Finally, FIG. 2 depicts a plurality of guide slots 92 which extend through the side walls of the packer tube 40. One or more conventional bolts 93 (see FIG. 3) or other appropriate connection means may be used to temporarily secure the position of the inflation element 52 relative to the packer tube 40. Once the bolts are removed, however, axial movement of the inflation element relative to the packer tube is permissible.

A suitable technique for circulating drilling mud through the casing string from the lowermost end thereof into the well bore will now be discussed. FIGS. 3–6 depict a simplied casing circulator 30 according to the present invention adjacent the uppermost end of a casing string 32. The bales 24 and elevator 26 as shown in FIG. 1 are even more simplied than as depicted in FIGS. 3–6 since the primary emphasis of this discussion is based upon use of the casing circulator and its axial relationship with respect to the casing string 32 and elevator 26.

The pup joint 28 may initially be threaded to the actuator assembly within the top guide torque wrench 22, so that the casing circulator 30 threaded to the lower end of the pup joint is substantially axially aligned with respect to the casing string. The casing circulator may thus be suspended from the torque wrench 22 before the casing becomes struck in the well bore, and may be secured in its deflated position by the securing bolt previously discussed, which passes through slot 92 and thus connects the packer tube 40 and the inflation element 52. As each joint of casing is added to the drill string, the casing circulator 30 is "stabbed" into the top of the newly added casing without additional operator action, and the elevator 26 latched in a conventional manner.

Figure 3:
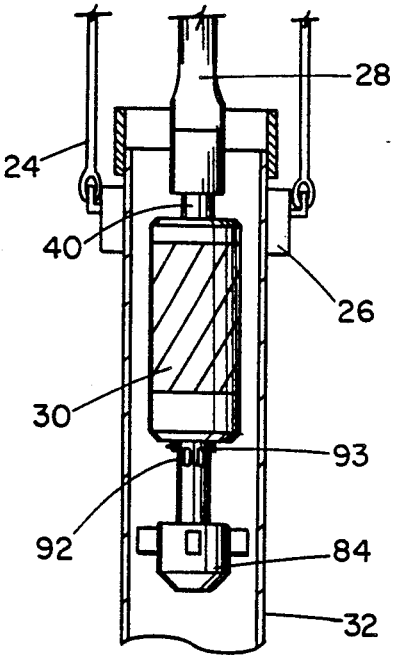
FIG. 3 is a simplified side view of a casing circulator in its unset position and opened for communicating fluid through the casing circulator and into the interior of the casing.
Figure 4:
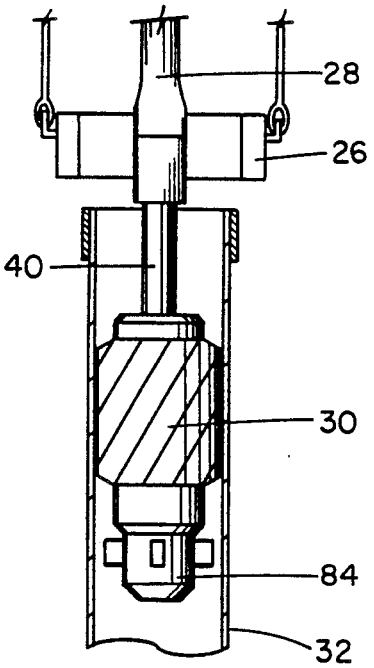
FIG. 4 is a simplified side view of a casing circulator in its set position with no fluid communciation between the interior of the casing string and the interior of the casing circulator.

In the event the casing string 32 becomes stuck in the well bore, the operator may first remove the securing bolt (or the bolt may already have been removed). The operator may then secure the casing at the rig floor 12, unlatch the elevator 26, then lower the bales 24, elevator 26, and casing circulator 30 by operating the drawworks so that the circulator 30 is stabbed into a casing string and substantially positioned within the uppermost end of the casing string 32 as shown in FIG. 3. (Elevator 26 need not be secured to the casing string at this stage.) With the securing bolt removed, the mud pumps may be activated to pass drilling mud through the interior of the packer tube 40 and into the annulus 74 to inflate the sealing element to its inflated position, as shown in FIG. 2. Once the desired inflation pressure is obtained, e.g., 1000 PSI, bales 24, elevator 26, and packer tube 40 may together be further lowered (slack off operation) so that the slots 92 drop below the seals 80. At this stage, the interior 38 of the casing circulator 30 is in fluid communication with the interior of the casing string, yet the casing circulator is maintained in its inflated position. Accordingly, the operator may then again activate the mud pump to pass fluid through the casing circulator to wash debris and lubricate the lowermost end of the casing string to enable further lowering of the casing string into the well bore. The elevator 26 is activated during this washing operation to grip the uppermost end of the casing string, and the casing string released at the rig floor, so that the casing circulator can be simultaneously lowered into the well bore by lowering the elevator 26 while the washing operation is occurring.

Figure 6:
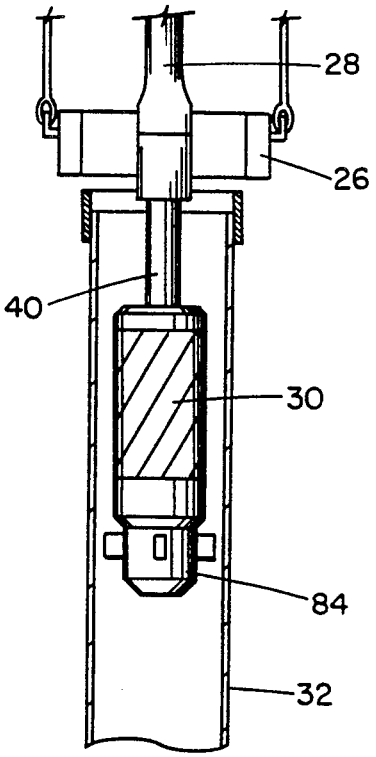
FIG. 6 is a simplified side view of a casing circulator in its unset condition with no fluid communication between the interior of the casing circulator and the interior of the casing.

At the end of the washing operation, the mud pumps may be deactivated and the pressure bled off the casing string. With the elevator 26 again detached from the casing string and the casing secured at the rig floor, the drawworks may be activated to "pick-up" on the casing circulator to cause the slots 92 to rise above the seals 80. This action causes the annulus 74 to be in fluid communication with the interior 38 of the packer tube 40 and thus the interior of the casing string to deflate the casing circulator to the position as shown in FIG. 6. In the event that it is desired to thereafter repeat the above process to again wash fluid from the lowermost end of the casing string, the process may be easily repeated. The securing bolt, once removed, need not be reused each time the casing becomes stuck in the well bore.

In the event the technique of the present invention is employed with a rig which does not utilize a powered torque wrench (also referred to as a power swivel) above the elevator, an external flow line 29 as shown in FIG. 1 may extend from the upper end of the casing circulator 30 to a conventional pump. In this latter case, the top sub 44 may include external ears adapted for receiving hooks, so that chains or cables could be easily used to raise or lower the casing circulator, as desired, into and out of the top of the casing string. In this embodiment, the alternative flexible line 29 as shown in FIG. 1 could thus be connected to a single relatively small mud pump to set the casing circulator as described above, since the pup joint 28 would not be utilized. Generally, it is anticipated that between 250 and 1500 PSI and preferrably about 300 to 1000 PSI, is used to inflate the casing circulator according to the present invention. Accordingly, the concepts of the present invention are applicable to various types of rigs, but are particularly well suited for a top drive or side drive rig since flexible flow line 27 already extends to a position immediately above the casing circulator.

Referring again to FIG. 3, it should also be understood that the casing circulator of the present invention may also be used to easily fill the casing string with drilling mud as it is lowered into the well bore, thereby saving valuable rig time. Those skilled in the art appreciate that a significant differential in pressure covered by hydrostatic head must be avoided, and accordingly it is customary to intermittently fill the casing with a flexible hose when its uppermost end is generally adjacent the rig floor. To accomplish this filling function according to the present invention, the casing circulator 30 may be stabbed into the top of a newly added casing, as shown in FIG. 3, with the elevator 26 deactivated and the casing secured at the rig floor. The elevator 26 may then be activated to grip to the uppermost end of the casing string 32, and the casing released at the rig floor. As the draw works are activated and the casing string is lowered into the well bore, the mud pumps may be briefly activated to simulanteously fill the casing string, thereby minimizing the likelihood of collapse of the casing string. Although this objective customarily is accomplished in the prior art by manually placing the end of a flexible hose within the uppermost end of the casing string, the techniques of the present invention result in little or no additional time required to properly fill the casing string with drilling mud. Once the casing is properly filled, the mud pumps may be shut off, the elevator 26 unlocked, and the process repeated with the next joint of casing.

Figure 5:
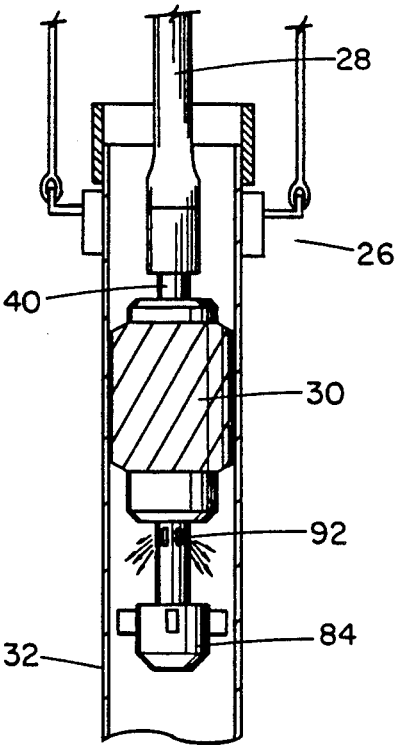
FIG. 5 is a simplified side view of the casing circulator in its set position, but with fluid communication permitted between the interior of the casing circulator and the interior of the casing.
Figure 7:
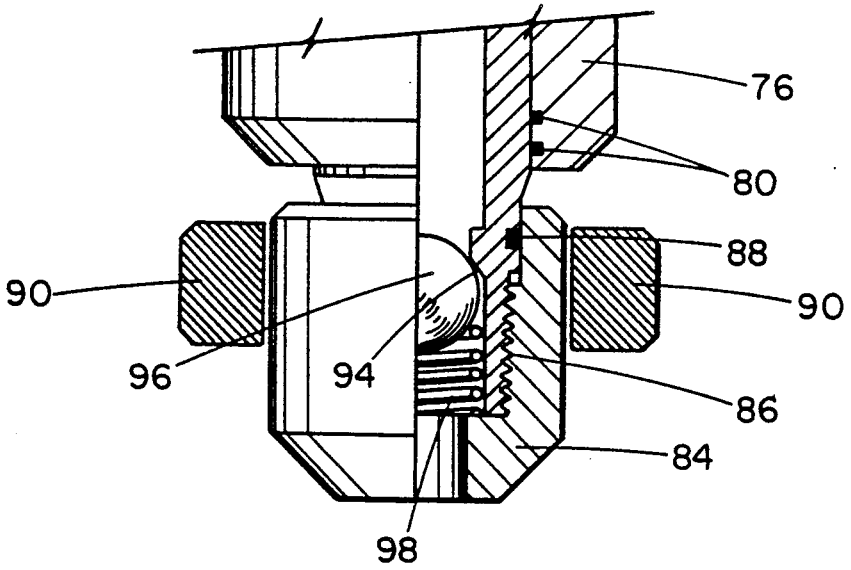
FIG. 7 is a half-sectional view of a lower portion of an alternate embodiment of the casing circulator shown in FIG. 2.

According to one embodiment of the invention, the internal surface of the packer tube 40 is cylindrical, thereby providing "full bore" for a passing drilling mud or other fluid through the assembly as shown in FIG. 2 and out the slots 92 (see FIG. 5). According to another embodiment, however, as shown in FIG. 7, the guide member 84 is not plugged, and a check valve may be provided at lowermost portion of the packer tube. Such a check valve may consist, for example, of a seating surface 94 and a metallic ball 96 adapted for sealing engagement with the surface 94, and biased into sealing engagement there with by spring 98 or other biasing means. Accordingly, as fluid flows to the casing circulator 30 and into the bore 38, fluid pressure in the bore must overcome the biasing force of the spring 98. Typically from between approximately 200 PSI to approximately 600 PSI would be preferred to open the check valve and allow fluid to flow through the casing circulator.

To activate the casing circulator with this check valve, mud pumps may be used to inflate the sealing element 52 to the desired inflation pressure. The check valve would then automatically open once this pressure was obtained and the casing circulator was set, and the drilling fluid would thereafter be pumped into the uppermost portion of the casing string. An advantage of this latter embodiment is that abrasion may be minimized since the abrasive fluid is not flowing through the device under a relatively low pressure. A disadvantage, however, is that the ball and sealing surface are additional components which wear and require maintenance. Also, this latter embodiment may not be easily used to fill the casing string as it is lowered into the bore hole, as discussed above. Other than the modification to the lower portion of the tool as shown in FIG. 7, the casing circulator could otherwise be fabricated and would operate as disclosed above.

As discussed earlier, the casing circulator can be easily adapted to top drive or side drive rigs, but may also be used with a conventional lower drive rig. Although a casing circulator with an inflatable sealing element is preferred according to the present invention, it should be understood that the invention is not necessarily limited to an inflatable sealing element, and a mechanically activated sealing element could also be used.

Various techniques may be employed to facilitate the release of the connection between the inflation element and the packer tube to place the casing circulator into service. Various conventional techniques may be used to remove the weight of the inflation element off the packer tube, thereby facilitating removal of the bolt 93 on other interconnection device. Also, the lower guide member 84 could include an axial through passageway (rather than being plugged as shown in FIG. 2), and an input tube could be added to allow an operator to easily drop a ball into the top of the casing circulator, which would then drop through the packer tube and create a fluid restriction through the axial passageway, so that an increase in fluid pressure would then set the sealing element. The operator would then pickup or setdown on the casing circulator to move the packer tube axially relative to the packer sealing element, as explained above, to open or close the slots 92. Thus various techniques are contemplated and are within the scope of this invention for releasably connecting the packer tube and sealing element, for allowing the fluid pressure to set the sealing element, and for thereafter allowing fluid flow through the set casing circulator and into the casing.

Although the invention has been described in terms of the specific embodiments which are set forth herein, it should be understood that this is by illustration only and that the invention is not necessarily limited thereto. Alternative embodiments and operating techniques will become apparent to those skilled in the art in view of this disclosure. Accordingly, further modifications are contemplated and can be made without departing from the spirit and scope of the invention.

The casing circulator 30 may thus be used to easily fill the casing string as it is lowered in the bore hole, utilizing a process which maintains the desired hydrostatic head within the casing string yet requires no additional operator (or rig) time. Fluid is simply pumped through the casing circulator 30, preferably as the casing string is lowered into the well, so that time is saved by not having to have an operator intermittedly fill the casing string with fluid. Also, the apparatus of the present invention can be easily used to pressure test casing, since the casing circulator discussed herein is able to reliably seal the top of the casing string and thereby establish the necessary sealed cavity within the casing string to conduct the pressure test.

What is claimed is:

1. An improved method of circulating fluid through a casing string and from a lowermost end of a casing string into a well bore for facilitating lowering of the casing string into the well bore, an uppermost end of the casing string extending above the rig floor to a position adjacent an elevator for grasping the uppermost end of the casing string and moving the casing string axially with respect to the rig floor, the method comprising:

providing a casing circulator having an exterior sealing member and an interior packer tube defining a fluid flow path;

moving the casing circulator axially to a position within the uppermost end of the casing string;

thereafter activating the casing circulator to seal the sealing member between the casing string and the interior packer tube;

establishing fluid communciation between the interior of the packer tube and the interior of the casing string below the casing circulator sealing element while maintaining the sealing element in its sealed position;

thereafter pumping fluid through the casing circulator and into the casing string to wash the well bore adjacent the lowermost end of the casing string;

thereafter deactivating the casing circulator to unseal the sealing element from the casing string; and thereafter lowering the casing string into the well bore by lowering the elevator.

2. The method as defined in claim 1, further comprising:

providing one or more openings radially through the packer tube; and the step of establishing fluid communication includes lowering the packer tube axially with respect to the sealing member such that the one or more openings establish fluid communication while the packer tube is in its lowered position.

3. The method as defined in claim 2, wherein the step of activating the sealing element comprises:

passing pressurized fluid through the one or more openings and into engagement with the sealing element to inflate the sealing element.

4. The method as defined in claim 2, further comprising:

temporarily interconnecting the packer tube and the sealing element to maintain the packer tube in its upward position; and the step of activating the casing circulator includes removing the temporary interconnection between the packer tube and the sealing member.

5. The method as defined in claim 1, further comprising:

passing fluid through the casing circulator and into the casing string while the casing string is lowered into the well bore.

6. The method as defined in claim 1, further comprising:

the fluid is drilling mud; and activating one or more mud pumps to pump the drilling mud through the casing circulator.

7. The method as defined in claim 1, wherein the casing circulator is deactivated by moving the packer tube axially with respect to the sealing member.

8. The method as defined in claim 1, wherein the step of activating the casing circulator comprises:

pumping fluid into engagement with the sealing element to inflate the sealing element.

9. The method as defined in claim 1, further comprising:

positioning a check valve between the fluid flow path within the packer tube and the interior of the casing string for preventing flow of fluid through the casing circulator and into the casing string; and the step of establishing fluid communication includes pressurizing the fluid pumped through the casing circulator to a pressure sufficient to automatically open the check valve and thereby establish the fluid communication.

10. The method as defined in claim 1, further comprising:

passing fluid through the casing circulator and into the casing string to maintain a desired level of fluid in the casing string as the casing string is lowered into the well bore.

11. An improved method of circulating drilling mud from adjacent a lowermost end of a casing string in a well bore so that the casing string may be lowered into the well bore, the lowering of the casing string into the well bore being controlled by regulating downward movement of traveling blocks with respect to a rig floor, an uppermost end of the casing string extending above the rig floor to a position adjacent an elevator suspended from the traveling blocks for selectively grasping the uppermost end of the casing string, the method comprising:

providing a casing circulator having an exterior sealing member and an interior packer tube defining a fluid flow path;

suspending the casing circulator from the traveling blocks while securing the casing string in a fixed position with respect to the rig floor;

lowering the travel block to a position such that the casing circulator is within the uppermost end of the casing string at a position above the rig floor while the casing string is fixed with respect to the rig floor;

thereafter activating the casing circulator to seal the sealing member between the casing string and the interior packer tube;

establishing fluid communciation between the interior of the packer tube and the interior of the casing string below the casing circulator while maintaining the sealing element in its sealed position;

thereafter pumping the drilling mud through the casing circulator and into the casing string to wash the well bore adjacent the lowermost end of the casing string;

thereafter deactivating the casing circulator to unseal the sealing element from the casing string; and releasing the casing string from its fixed position, fixing the casing string to the elevator, and lowering the elevator to lower the casing string further into the well bore.

12. The method as defined in claim 11, further comprising:

providing one or more openings radially through the packer tube;

the step of establishing fluid communication includes lowering the packer tube axially with respect to the sealing member such that the one or more openings establish fluid communication while the packer tube is in its lowered position; and the step of activating the sealing element comprises passing pressurized fluid through the one or more openings and into engagement with the sealing element to inflate the sealing element.

13. The method as defined in claim 11, further comprising:

providing one or more openings radially through the packer tube;

temporarily interconnecting the packer tube and the sealing element to maintain the sealing element in its upward position;

a step of activating the casing circulator includes removing the temporary interconnection between the packer tube and the sealing member; and the step of establishing fluid communication includes lowering the packer tube axially with respect to the sealing member such that the one or more openings establish fluid communication while the packer tube is in its lowered position.

14. The method as defined in claim 11, further comprising:

passing fluid through the casing circulator and into the casing string while the casing string is lowered into the well bore.

15. The method as defined in claim 11, wherein the casing circulator is deactivated by moving the packer tube axially with respect to the sealing member.

16. The method as defined in claim 11, further comprising:

passing fluid through the casing circulator and into the casing string to maintain a desired level of fluid in the casing string as the casing string is lowered into the well bore.

17. A casing circulator for temporarily sealing the uppermost end of a casing string extending into a well bore, the uppermost end of the casing string extending above the rig floor to a position adjacent an elevator suspended from traveling blocks, the casing circulator comprising:

packer tube means and defining a fluid flow path there through;

external sealing sleeve means radially outward of the packer tube means and formed from an elastomeric material for sealing engagement with an internal surface of the uppermost end of the casing string;

the sealing sleeve means being radially moveable with respect to the packer tube means and sealed therewith at both its upper end and its lower end;

one or more ports extending radially through the packer tube means for providing fluid communication between the fluid flow path and the interior of the casing string, and between the fluid flow path and an interior surface of the sealing sleeve means as a function of the axial position of the sealing sleeve means with respect to the packer tube means; and guiding means secured to a lower end of a packer tube means for directing the sealing sleeve means downward into the uppermost end of the casing string.

18. The casing circulator as defined in claim 17, further comprising:

interconnecting means for temporarily fixing the axial position of the sealing sleeve means with respect to the packer tube means.

19. The casing circulator as defined in claim 17, further comprising:

a check valve positioned between the fluid flow path and the interior of the uppermost portion of a casing string for prohibiting fluid from flowing from the flow path to the interior of the casing string until pressure within the flow path means reaches a predetermined value.

20. The casing circulator as defined in claim 17, further comprising:

an upper packer head axially moveable with respect to the packer tube while maintaining sealed engagement therewith;

a lower packer head axially moveable with respect to the packer tube while maintaining sealed engagement therewith; and an upper end and a lower end of the sealing sleeve means are each sealingly connected to the upper and lower packer head, respectively.

* * * * *

UNITED STATES PATENT AND TRADEMARK OFFICE

CERTIFICATE OF CORRECTION

PATENT NO. : 4,997,042
DATED : March 5, 1991
INVENTOR(S) : Jordan et al.

It is certified that error appears in the above-indentified patent and that said Letters Patent is hereby corrected as shown below:

In col. 9, lines 15 & 16, (Claim 1, lines 17 & 18) delete "interior of" and insert --fluid flow path--

In col. 9, line 16, (Claim 1, line 19) delete "the" after "packer tube and" and insert --an--.

In col. 9, line 17, (Claim 1, line 20) delete "element" and insert --member--.

In col. 9, line 18, (Claim 1, line 21) delete "element" and insert --member--.

In col. 9, line 24, (Claim 1, line 26) delete "element" and insert --member--.

In col. 9, line 37, (Claim 3, line 11) delete "element" and insert --member--.

In col. 9, line 40, (Claim 3, line 14) delete "element" (both occurrences) and insert --member--.

In col. 9, line 44, (Claim 4, line 4) delete "element" and insert --member--.

In col. 9, lines 64 & 65, (Claim 8, lines 3 & 4) delete "element" and insert --member--.

In col. 9, line 65, (Claim 8, line 4) delete "element" and insert --member--.

In col. 10, line 33, (Claim 11, line 18) delete "block" and insert --blocks--.

In col. 10, lines 41 & 42, (Claim 11, lines 26 & 27) delete "interior of" and insert --fluid flow path in--.

In col. 10, line 42, (Claim 11, line 27)delete "the" after "packer tube and" and insert --an--.

UNITED STATES PATENT AND TRADEMARK OFFICE

CERTIFICATE OF CORRECTION

PATENT NO. : 4,997,042
DATED : March 5, 1991
INVENTOR(S) : Jordan et al.

It is certified that error appears in the above-indentified patent and that said Letters Patent is hereby corrected as shown below:

In col. 10, line 44, (Claim 11, line 29) delete "element" and insert --member--.

In col. 10, line 50, (Claim 11, line 35) delete "element" and insert --member--.

In col. 10, line 64, (Claim 12, line 10) delete "element" and insert --member--.

In col. 10, line 67, (Claim 12, line 13) delete "element" (both occ.) and insert member--.

In col. 11, line 6, (Claim 13, line 6) delete "element" (both occurrences) and insert --member--.

In col. 11, line 36, (Claim 17, line 7) delete "and".

In col. 11, line 37, (Claim 17, line 8) delete "there through" and insert --therethrough--.

In col. 12, line 8, (Claim 17, line 18) after "fluid flow path and" delete "the" and insert --an--.

In col. 12, line 26, (Claim 19, line 4) delete "the interior of the" and insert --an interior of an--.

In col. 12, line 29, (Claim 19, line 7) delete "means".

In col. 12, line 34, (Claim 20, line 4) after "the packer tube" insert --means--.

In col. 12, line 37, (Claim 20, line 7) after "the packer tube" insert --means--.

UNITED STATES PATENT AND TRADEMARK OFFICE

CERTIFICATE OF CORRECTION

PATENT NO. : 4,997,042

DATED : March 5, 1991

INVENTOR(S) : Jordan et al.

It is certified that error appears in the above-indentified patent and that said Letters Patent is hereby corrected as shown below:

In col. 12, line 37, (Claim 20, line 7) after "the packer tube" insert --means--

Signed and Sealed this

Fourteenth Day of July, 1998

Bruce Lehman

*Attest:*

BRUCE LEHMAN

*Attesting Officer*

*Commissioner of Patents and Trademarks*